US007624785B2

(12) United States Patent
Yu et al.

(10) Patent No.: US 7,624,785 B2
(45) Date of Patent: Dec. 1, 2009

(54) SELF-RAISING WINDOW COVERING

(75) Inventors: Fu-Lai Yu, Taipei Hsieh (TW); Chin-Tien Huang, Taipei Hsieh (TW)

(73) Assignee: Teh Yor Co., Ltd. (TW)

( * ) Notice: Subject to any disclaimer, the term of this patent is extended or adjusted under 35 U.S.C. 154(b) by 0 days.

(21) Appl. No.: 11/880,000

(22) Filed: Jul. 19, 2007

(65) Prior Publication Data

US 2009/0020239 A1 Jan. 22, 2009

(51) Int. Cl.
*E06B 9/30* (2006.01)

(52) U.S. Cl. ..... 160/171; 160/173 R

(58) Field of Classification Search ..... 160/84.04, 160/84.05, 171, 170, 168.1 R, 173 R, 178.1 R, 160/296
See application file for complete search history.

(56) References Cited

U.S. PATENT DOCUMENTS

| | | | | | |
|---|---|---|---|---|---|
| 13,251 | A | | 7/1855 | Bixler | |
| 2,266,160 | A | * | 12/1941 | Burns | 160/170 |
| 2,276,716 | A | * | 3/1942 | Cardona | 160/170 |
| 2,420,301 | A | | 5/1947 | Cusumano | |
| 2,520,629 | A | * | 8/1950 | Esposito | 160/171 |
| 3,487,875 | A | * | 1/1970 | Shukat et al. | 160/84.01 |
| 4,498,517 | A | * | 2/1985 | Mase | 160/294 |
| 5,054,162 | A | | 10/1991 | Rogers | |
| 5,133,399 | A | * | 7/1992 | Hiller et al. | 160/171 |
| 5,706,876 | A | | 1/1998 | Lysyj | |
| 6,003,584 | A | | 12/1999 | Weinreich | |
| 6,047,759 | A | * | 4/2000 | Lysyj | 160/84.04 |
| 6,056,036 | A | | 5/2000 | Todd et al. | |
| 6,129,131 | A | | 10/2000 | Colson | |
| 6,155,328 | A | | 12/2000 | Welfonder | |
| 6,223,802 | B1 | | 5/2001 | Colson | |
| 6,234,236 | B1 | | 5/2001 | Kuhar | |
| 6,289,965 | B1 | | 9/2001 | Ruggles | |
| 6,325,131 | B1 | | 12/2001 | Dekker et al. | |
| 6,435,252 | B2 | | 8/2002 | Colson et al. | |
| 6,474,394 | B2 | | 11/2002 | Kuhar | |
| 6,536,503 | B1 | | 3/2003 | Anderson et al. | |
| 6,571,853 | B1 | | 6/2003 | Ciuca | |
| 6,622,769 | B2 | * | 9/2003 | Judkins | 160/84.05 |
| 6,662,850 | B2 | | 12/2003 | Chung et al. | |
| 6,666,252 | B2 | * | 12/2003 | Welfonder | 160/296 |
| 6,725,897 | B2 | | 4/2004 | Palmer | |
| 6,752,194 | B1 | | 6/2004 | Huang | |

(Continued)

*Primary Examiner*—Blair M. Johnson
(74) *Attorney, Agent, or Firm*—Olson & Cepuritis, Ltd.

(57) ABSTRACT

The present invention relates to a self-raising window covering and a control mechanism for the window covering. In particular, the window covering includes a drive unit, such as constant force spring, that is adapted to apply a substantially constant rotational force on the drive axle. A cord winding assembly is coaxially mounted on the drive axle, and includes at least one winding drum operatively connected to a second end of the raising cord and having a tapered portion, as well as a rotatable positioning member for moving the cord winding assembly laterally along the drive axle upon rotation of the positioning member. The cord winding assembly is adapted to translate the rotational force on the drive axle to a raising force on the raising cord, wherein the raising force is greater than a downward force exerted by the shade element and bottom rail throughout the range of opening and closing. A clutch member or locking member is also operatively connected with the axle and adapted to releasably lock the drive axle in a desired position.

26 Claims, 6 Drawing Sheets

U.S. PATENT DOCUMENTS

| | | | | |
|---|---|---|---|---|
| 6,789,598 | B2 | 9/2004 | Nien | |
| 6,854,503 | B2 * | 2/2005 | Cross et al. | 160/168.1 R |
| 6,854,505 | B2 | 2/2005 | Grubb et al. | |
| 7,025,107 | B2 | 4/2006 | Ciuca | |
| 7,063,122 | B2 | 6/2006 | Colson et al. | |
| 7,137,430 | B2 | 11/2006 | Fraczek | |
| 7,168,476 | B2 | 1/2007 | Chen | |
| 7,185,691 | B2 | 3/2007 | Toti | |
| 2004/0144501 | A1 | 7/2004 | Oskam et al. | |
| 2004/0154758 | A1 | 8/2004 | Cheng et al. | |
| 2004/0177933 | A1 | 9/2004 | Hillman | |
| 2004/0182526 | A1 | 9/2004 | Strand et al. | |
| 2005/0109471 | A1 | 5/2005 | Strand et al. | |
| 2006/0037720 | A1 * | 2/2006 | Huang | 160/171 |
| 2006/0151126 | A1 | 7/2006 | Lampe | |
| 2007/0012407 | A1 | 1/2007 | Nien | |
| 2007/0039696 | A1 | 2/2007 | Strand et al. | |
| 2009/0020239 | A1 * | 1/2009 | Yu et al. | 160/331 |

* cited by examiner

SELF-RAISING WINDOW COVERING

FIELD OF INVENTION

The present invention relates to a window covering that may be raised without the need to apply a force to either a control mechanism or the window covering itself as the window covering is opened. In particular, the present invention relates to a window covering having a control mechanism configured to exert an upward force on the shade element and bottom rail that is of sufficient magnitude to raise the shade element and bottom rail without additional force being applied by the user during raising.

BACKGROUND OF THE INVENTION

Window shades and coverings are found in many applications and used to regulate the amount of light entering a room, and to provide aesthetic appeal to a decor. Such window shades and coverings take many forms, including roller shades, Roman shades, Venetian blinds, and cellular shades. Conventional cellular or pleated shades utilize cord locks or a transmission mechanism to raise, lower and position the window covering in a desired position. With window coverings utilizing a cord lock, cords run up through the folded fabric, across the inside of a head rail and exit through a locking mechanism. Other cellular shades include a transmission mechanism and a continuous loop cord that is pulled by a user to raise and lower the window shade. Roman shades and Venetian blinds also tend to include raising cords that are secured to a lower bar or bottom rail.

There are some disadvantages to these designs. Cords present the potential hazard of a child getting caught in or strangled by the exposed control cord. Cords also tend to distract from the aesthetics of a window covering in that they extend along the face of the window covering and, when the window shade is opened, must either be wrapped on a hook or just left on the floor. With window coverings that utilize cord locks, the cords also experience substantial wear due to friction against surfaces as a result of raising and lowering of the window covering.

Other window coverings include common roller shades, which operate in the absence of a cord. These roller shades include a wound torsion-spring retraction mechanism in combination with a clutch or locking mechanism mounted with a roller onto which the shade is rolled and collected. In operation, a roller shade is pulled down by a user to a desired location, where it is locked in place by the clutch or locking mechanism. To unlock and release the shade so that it may be raised, the user typically pulls on a bottom rail of the shade, extending the shade sufficiently to disengage the internal clutch or locking mechanism within. When the clutch or locking mechanism is disengaged and the user releases the shade, the shade is retracted using the torsion-spring driven retraction mechanism. Known roller shades, however, are only operable with flat shade material which rolls up neatly into a confined location.

The mechanism utilized in such roller shades is not compatible with other window coverings, such as cellular shades, Venetian blinds, and Roman shades. As roller shades are raised, the amount of shade being lifted decreases such that a constant force torsional spring member is capable of applying the necessary winding or upward force throughout the opening range. By contrast, a similar lifting mechanism is typically unsuitable in cellular shades, Venetian blinds, and Roman shades. In these types of window coverings the material of the shade element is typically gathered by raising a bottom member, such as a bottom rail, and increasing amounts of weight are gathered on the bottom member as the window covering is raised. The reason for this is that the shade material or shade element increasingly stacks on the bottom rail as the bottom rail rises, which increases the load on the lifting mechanism.

In order to address this increasing weight, very strong torsional springs have been used to accommodate the maximum weight of the shade. One drawback to this approach, however, is that the rate at which the window covering is retracted may be too fast and uncontrolled. One attempt to address this problem is found in U.S. Pat. No. 6,666,252, issued to Welfonder. This patent teaches the use of a fluid brake to control the rate at which the raising cords are retracted throughout the raising process. Another approach that has been used is shown in U.S. Pat. No. 6,056,036, issued to Todd, which employs a mechanical friction member to continuously slow the rate of retraction. One problem with these approaches has been that the spring utilized exerts a force that makes it difficult for a user to overcome when attempting to lower the shade. Excessive pulling force by the user often results in damage to the window covering.

Alternatively, variable force springs have been used. Such variable force springs are substantially more complicated in use and manufacture.

Therefore, there is a need for a window covering raising mechanism for window coverings such as Venetian blinds, cellular shades and Roman shades that is self-raising and overcomes the foregoing problems.

SUMMARY OF THE INVENTION

The present invention relates to a self-raising window covering and a control mechanism for the window covering. In particular, the window covering is a self-raising window covering that includes a head rail, a shade element, such as a cellular panel, blind slats, or Roman shade material, a bottom rail, at least one raising cord operatively connected at a first end to the bottom rail, and a control mechanism. The head rail may define an elongated channel wherein the control mechanism is disposed therein. In some embodiments, the control mechanism includes a drive axle and a drive unit operatively connected with the drive axle. The drive unit, which may be a constant force spring, is adapted to provide a substantially constant rotational force on the drive axle.

At least one cord winding assembly is also provided in co-axial relation with the drive axle. Typically, the number of cord winding assemblies will be the same as the number of raising cords. However, in some instances, one cord winding assembly may be adapted to operate with multiple cords. The cord winding assembly includes at least one winding drum operatively connected to a second end of the raising cord and having a tapered portion. The cord winding assembly also includes a rotatable positioning member for moving the cord winding assembly laterally along the drive axle upon rotation of the positioning member. In a preferred embodiment, the positioning member is a threaded tubular member connected to the winding drum. The cord winding assembly is adapted to translate the rotational force on the drive axle to a raising force on the raising cord, wherein the raising force is greater than a total downward force exerted by the shade element and bottom rail throughout the range of opening and closing. In a preferred embodiment, the cord winding assembly is rotationally secured with the drive axle by a hub member adapted to engage the cord winding assembly and the drive axle. The hub member may be in a sliding relationship with the tapered portion of the cord winding assembly.

A clutch member or locking member is also operatively connected with the axle and adapted to releasably lock the drive axle in a desired position. In a preferred embodiment, the clutch member comprises a reciprocator disposed coaxially relative to the drive axle and movable between a released position and a locked position, and a spring member connected to the reciprocator and operable to either tighten or relax the hold of the reciprocator on the drive axle. The reciprocator is configured to cause the spring member to tighten on the drive axle in the locked position for blocking a rotation of the drive axle against the rotational force applied by the drive unit, and cause the spring member to relax the drive axle in the released position to permit a rotation of the drive axle under the rotational force applied by the drive unit

DETAILED DESCRIPTION OF PREFERRED EMBODIMENTS

Figure 1:
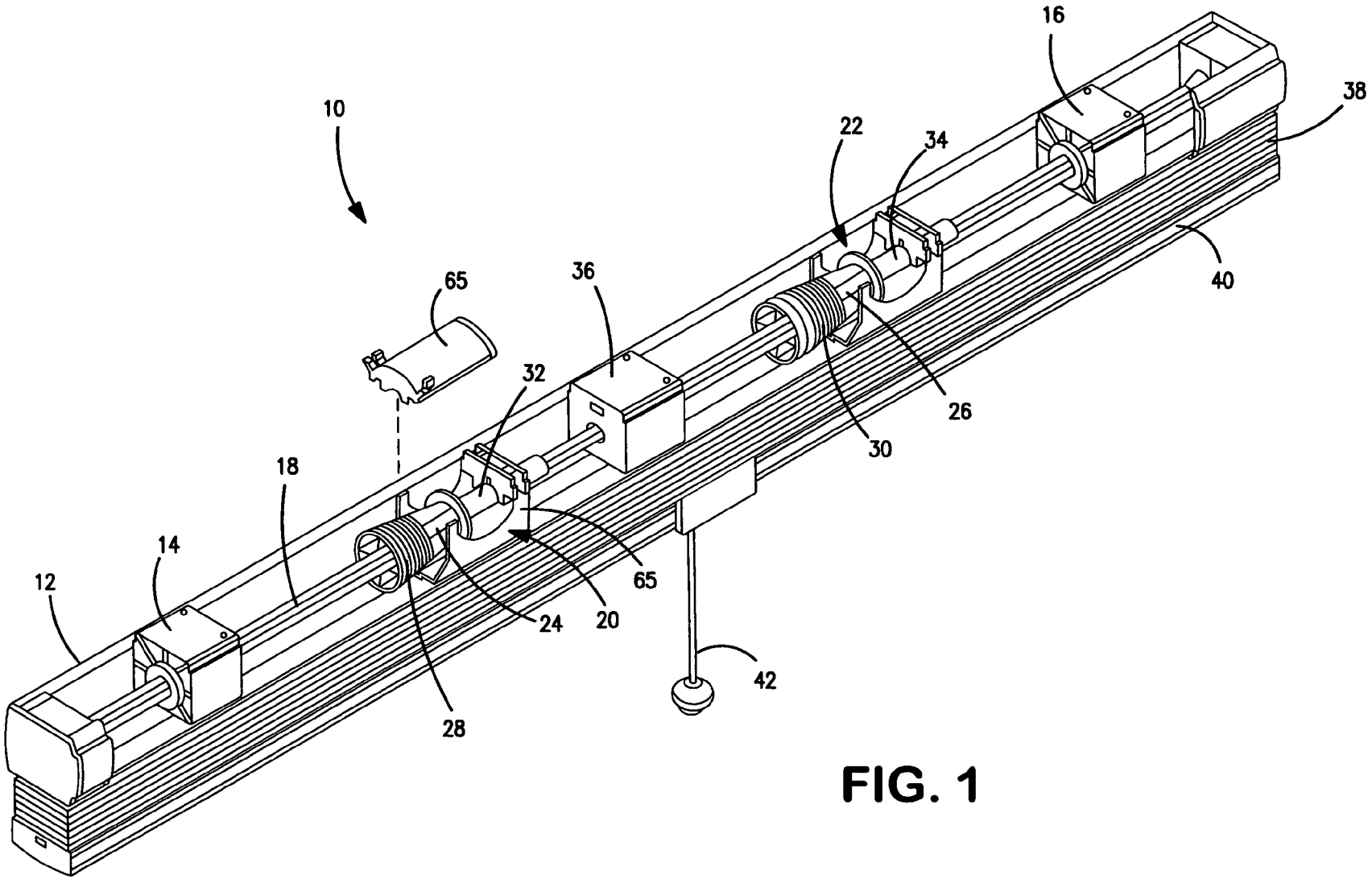
FIG. 1 is a perspective view, partly in cutaway, of a preferred embodiment of a window covering according to the present invention.

The invention disclosed herein is susceptible to embodiment in many different forms. Shown in the drawings and described in detail hereinbelow are preferred embodiments of the present invention. The present disclosure, however, is only an exemplification of the principles and features of the invention, and does not limit the invention to the illustrated embodiments.

Referring to FIG. 1, an embodiment of a self-raising window covering 10 according to the present invention is shown. A head rail 12 defining a channel is provided. A pair of drive units, such as spring units 14 and 16 are coaxially mounted about a drive axle 18. Also mounted on drive axle 18 are cord winding assemblies 20 and 22. Each of cord winding assemblies 20 and 22 includes a frustoconical winding drum 24 and 26, and a threaded tubular member 32 and 34, respectively. Raising cords 28 and 30, which are shown as wound on winding drums 24 and 26, are secured at an end to the winding drums 24 and 26. In this embodiment, a clutch 36 is also provided and co-axially mounted on the drive axle 18. Each of these components is discussed in greater detail below. Window covering 10 further includes a shade element, such as cellular shade material 38 and a bottom member, such as bottom rail 40. The term "cord" as used may encompass a cord, strip, ribbon, string or any similar flexible elongated elements that are suitable for supporting the suspended shade element, and can be wound or unwound to deploy or retract the shade element. A relatively short length of cord 42 can also be provided so that the user can pull down the window covering and, as will be discussed in further detail, release the clutch so that the window covering will retract itself.

Figure 2:
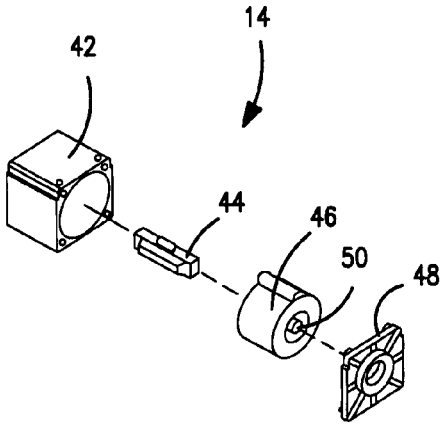
FIG. 2 is an exploded perspective view of the single spring coil drive unit of FIG. 1.

Referring to FIG. 2, a preferred embodiment of the spring unit 14 is shown. The spring unit 14 comprises a spring casing 42, a spring axle 44, a constant force coil spring 46 and a cover 48. The coil spring 46 and the spring axle 44 are secured within the casing 42, which is closed by cover 48. A first end 50 of the coil spring 46 is secured to the spring axle 44, which is coaxially connected to the drive axle 18 (FIG. 1). In this preferred embodiment, the coil spring is configured to provide sufficient rotational force to the drive axle 18 and winding drums 24 and 26 to raise the shade element and bottom rail. Other alternative embodiments of spring units are also possible, such as shown in FIGS. 3-6.

Figure 3:
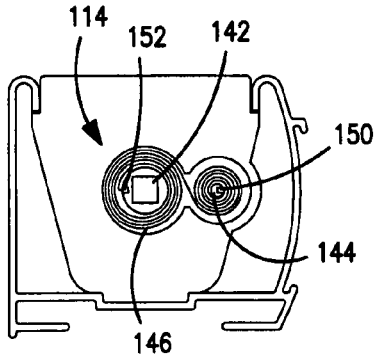
FIG. 3 is a side elevational cross section view of the single spring coil drive unit of FIG. 1.

For example, a suitable spring unit 114 shown in FIG. 3 may include a coiled spring member 146 having a first end secured with a first spring axle 142 that connects to the drive axle 18 shown in FIG. 1, and a second end secured with a second spring axle 144 that is offset from the first spring axle 142. The coiled spring 146 in a relaxed position may be initially wound around the second spring axle 144. As the shade element is pulled downward, the coiled spring 146 may stretch out from the second spring axle 144 and progressively wind around the first spring axle 142. This configuration of the spring unit 114 may be suitable when the used coiled spring 146 has a greater length to allow a longer deployment range of the shade element.

Figure 4:
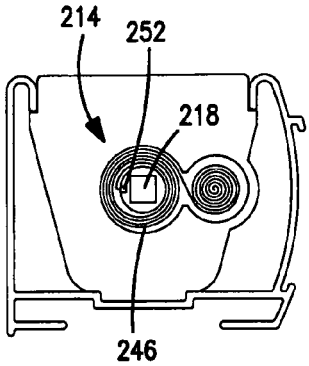
FIG. 4 is a side elevational cross section view of an alternative single spring coil drive unit.

FIG. 4 illustrates another suitable spring unit 214, which is similar to the embodiment shown in FIG. 3 except that the second end of the coiled spring does not connect to any second spring axle. Instead, the coiled spring 246 winds on itself at its second end, while the first end 252 of the coiled spring 246 connects to a single spring axle 218 connected to the drive axle 18 shown in FIG. 1.

Figure 6:
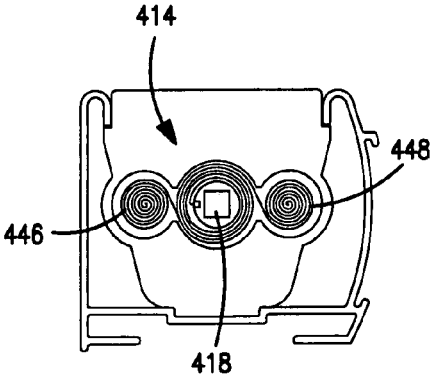
FIG. 6 is a side elevational cross section view of an alternative double spring drive unit.
Figure 5:
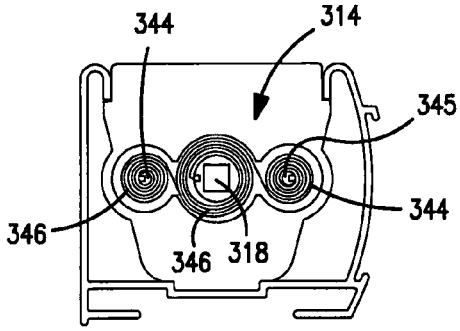
FIG. 5 is a side elevational cross section view of a double spring drive unit.

Still other suitable embodiments of spring units are shown in FIGS. 5 and 6. In FIG. 5, spring unit 314 includes an assembly of two coiled springs 346 and 348 that may be used to provide a greater raising force for the shade element. The first coiled spring 346 has its first end connected to a first spring axle 344, and the second coiled spring 348 has its first end connected to a second spring axle 345. The second end of the first coiled spring 346 and the second end of the second coiled spring 348 respectively connect to a third spring axle 318 located between the first and second spring axles 344 and 345 and connected to the drive axle 18. As the shade element is pulled downward, the coiled springs 346 and 348 may respectively stretch out from the first and second spring axle 344 and 345 to progressively wind around the third spring axle 318 to apply an increased raising force on the drive axle 18. In FIG. 6, the shown embodiment is very similar to that shown in FIG. 5 except that the two coiled springs 446 and 448 that wind on the axle 418 connected to the drive axle do not connect with second spring axles. Although each of the embodiments shown utilizes a spring as the driving mechanism for the drive unit, it should be understood that any suitable mechanism for imparting a rotational force on the drive axle may be utilized.

Figure 7:
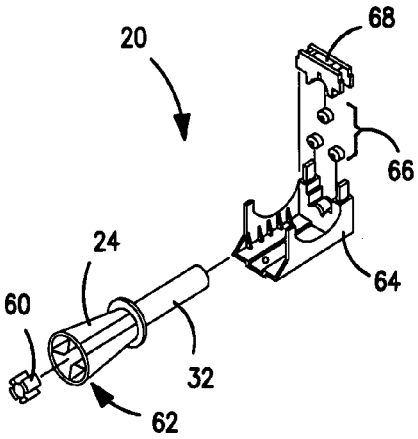
FIG. 7 is an exploded perspective view of the cord winding assembly shown in FIG. 1.

Referring again to FIG. 1, the rotational force exerted upon a drive axle 18 causes the cord winding assemblies 20 and 22 to rotate and translate for winding the cords 28 and 30, which thereby raises the shade element 38 vertically toward the head rail 12. Further details on a preferred embodiment of a cord winding assembly are provided with reference to FIG. 7.

Cord winding assembly 20 is mounted co-axially with the drive axle 18 that passes through a fixed housing comprised of a frame 64 and upper cover 65. The cord winding assembly 20 includes a winding drum 24 and a rotational positioning member, such as threaded tubular member 32, fixedly connected at an end of the winding drum 24. The cord winding assembly 20 is preferably mounted on the drive axle 18 via a hub member, such as adapter 60 that is configured to transmit rotational movement between the drive axle 18 and the cord winding assembly 20 while allowing a relative translation movement therebetween. In some embodiments, the adapter 60 may be coaxially mounted inside a central hole of the winding drum 24, and include a through hole for mounting the drive axle 18. To transfer rotational movement while permitting smooth relative translation between the winding drum 24 and the adapter 60, a peripheral surface of the adapter 60 may be provided with radial portions that contact with ribs protruding radially inward from the surface of the central hole of the winding drum 24. Further, the threaded tubular member 32 engages with toothed rollers 66, which are rotatably mounted to frame 64 and bracket 68 fixedly secured in head rail 12. Rotational movements thereby can be transferred between the drive axle 18 and the cord winding assembly 20, while smooth relative translations with reduced frictions are permitted therebetween. In addition, the engagement via the adapter 60 and the threaded tubular member 32 allows an improved support of the load of the suspended components, e.g. shade element 38 and bottom rail 40.

The winding drum 24 is tapered and is preferably frusto-conical in shape, and may include striations or grooves to improve gripping of the cord 28 wound on the surface of the winding drum 24. An end of the raising cord (not shown) is secured towards the larger diameter end 62 of the winding drum 24. As the cord winding assembly 20 rotates and translates in a direction to wind the raising cord 28, the raising cord is wrapped around increasingly narrower portions of the winding drum 24.

Figure 8B:
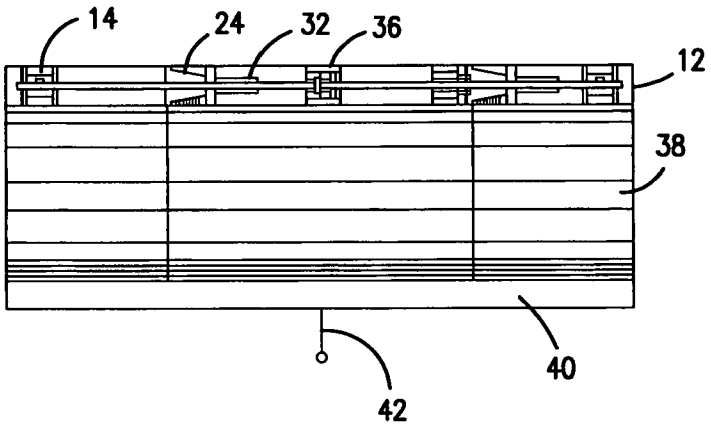
FIG. 8B is a front elevational view of the window covering of FIG. 1 in a partially open position and with the head rail in cross section.
Figure 8A:
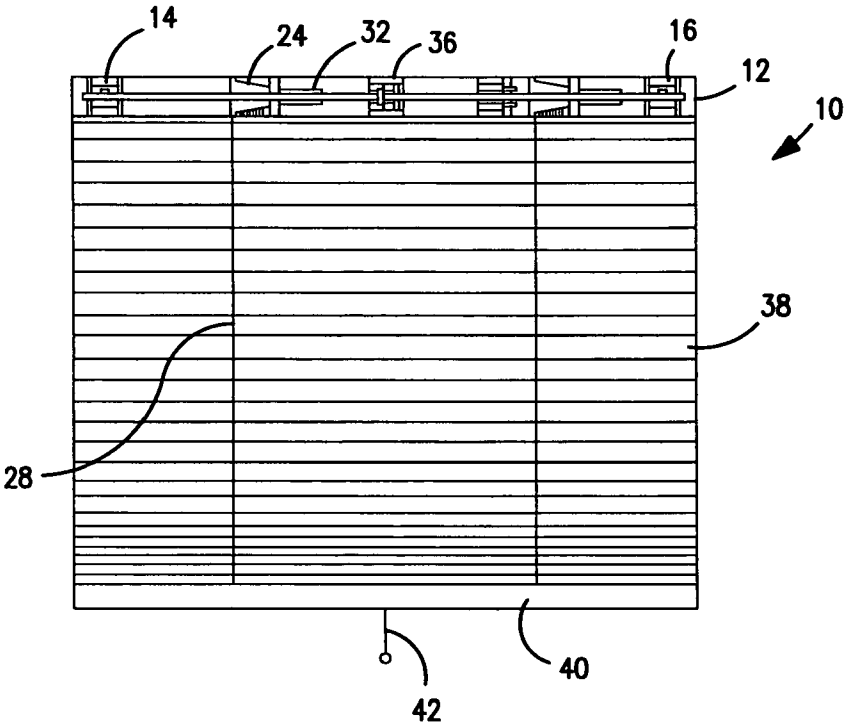
FIG. 8A is a front elevational view of the window covering of FIG. 1 in a closed position and with the head rail in cross section.

Referring to FIGS. 8A and 8B, the raising operation of the window covering is shown. When the shade element 38 is fully deployed, as shown in FIG. 8A, the raising cord 28 is fully extended from a wider portion of the winding drum 24. As the bottom rail 40 rises under the resilient force of the spring units 14 and 16, as shown in FIG. 8*b*, the threaded engagement between the threaded tubular member 32 and rollers 66 causes the rotating cord winding assembly 20 to move laterally within the head rail 12, such that the raising cord winds along the winding drum 24 towards its narrower end.

Because the rising bottom rail 40 causes the shade element 38 to collapse and stack up thereon, the total weight being raised by the resilient force applied by spring units 14 and 16 thus increases. The load on the spring units is now described with reference to one of the spring units. The load on one spring unit 14 is derived with an adequate scale factor from a momentum M on the drive axle 18 that can be approximated by the product between the suspended weight W, including the weight of the bottom rail plus the amount of shade element 38 stacked thereon, and a winding radius R of the winding drum 24. As the bottom rail 40 rises, W will increase, and R will decrease because the raising cord 28 winds on increasingly narrower portions of the tapered winding drum 24 that slide with reduced frictions owing to the adapter 60 and threaded tubular member 32 and adapter 60. Accordingly, even though the suspended weight W increases, the load M on one spring unit 14 can be kept at a level that varies slightly and can be overcome by the constant force spring 46 (FIG. 2) to fully raise the bottom rail 40 and shade element 38. In order to lower the window covering, a user exerts an approximately constant pulling force regardless of the position in height of the window covering. With the cord winding assemblies 20 and 22, spring units 14 and 16 of constant force thus can be suitably used to raise a suspended weight charge W that increases as it rises.

In some embodiments, such as the one depicted, the shade element itself may have an effect on the total downward force or suspended weight. For example, where the shade element is a cellular window covering, an inherent upward spring bias to the material may serve to decrease the total downward force. The total contribution of this spring bias varies depending on the degree to which the cellular window covering is extended.

As explained, as the window covering opens, the total weight suspended increases and the total raising force decreases. As such, the rate at which the window cover raises decreases as it nears a fully opened condition. Therefore, the shortcoming typically found in roller shade where the shade is retracted to quickly and violently avoided.

Figure 9A:
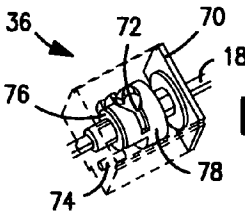
FIG. 9A is a perspective view of a preferred clutch member when the window covering is in a fully raised position.
Figure 9B:
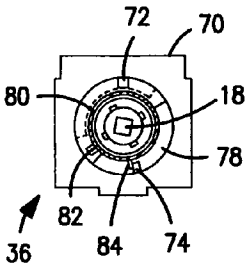
FIG. 9B is a cross sectional view of the clutch member of FIG. 9A.

Referring again to FIG. 6, the clutch member 36 is provided in order to lock the shade element 38 and bottom rail 40 in a desired position. Clutch member 36 is mounted coaxially with the drive axle 18 and is configured to unlock the drive axle 18 as the user pulls down the bottom rail 40 to stretch the shade element 38, and to lock the drive axle 18 when the user releases the bottom rail 40 at the desired height. When the user pulls down slightly on the bottom rail again, the clutch disengages and allows the bottom rail 40 to be raised by the spring units 14 and 16. Referring to FIGS. 9A and 9B, the clutch member 36 includes a casing 70 that has fixed protrusions 72 and 74. A collar 76 rotating with the drive axle 18 is provided, which reciprocates axially along the drive axle 18.

A reciprocator 78 is co-axially mounted over collar 76 and is movable both rotatably and axially therewith. A spring 80 having a first end 82 and a second end 84 is provided between collar 76 and reciprocator 78.

Figure 10A:
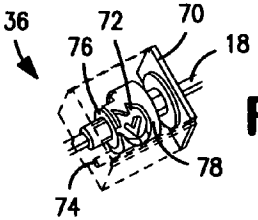
FIG. 10A is a perspective view of the clutch member of FIG. 9A as the user pulls down on the window covering.
Figure 11A:
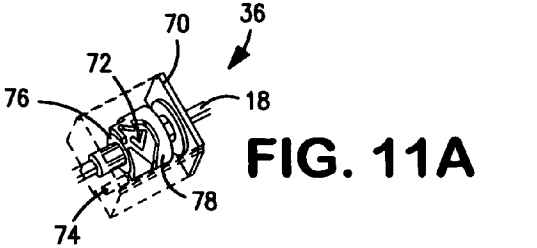
FIG. 11A is a perspective view of the clutch member of FIG. 9A as the user releases the window covering.
Figure 10B:
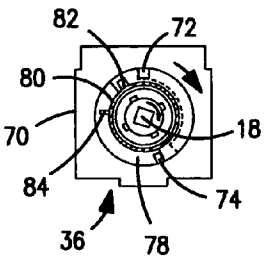
FIG. 10B is a cross sectional view of the clutch member of FIG. 10A.
Figure 11B:
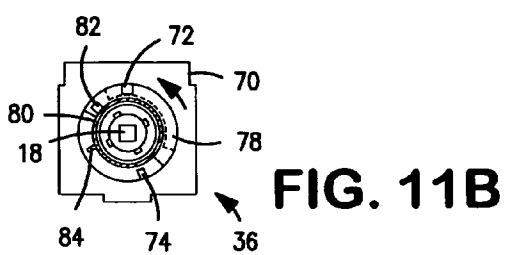
FIG. 11B is a cross sectional view of the clutch member of FIG. 11A.
Figure 12A:
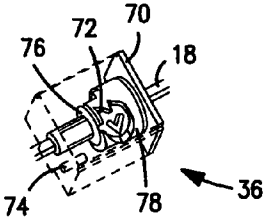
FIG. 12A is a perspective view of the clutch member of FIG. 9A as the user pulls down on the window covering to release the clutch member.
Figure 13A:
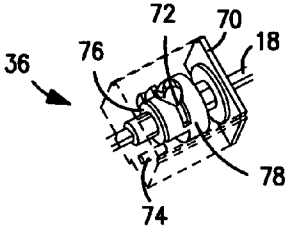
FIG. 13A is a perspective view of the clutch member of FIG. 9A as the window covering self-raises.
Figure 12B:
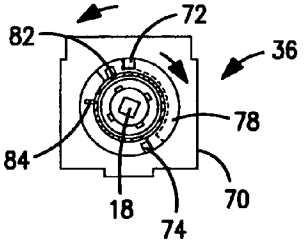
FIG. 12B is a cross sectional view of the clutch member of FIG. 12A.
Figure 13B:
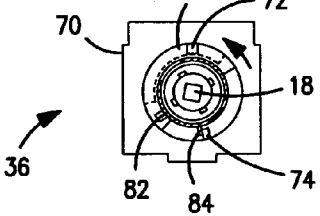
FIG. 13B is a cross sectional view of the clutch member of FIG. 13A.

FIGS. 9A and 9B show the clutch when the window covering 10 is in a fully raised position. Spring 80 is in a relaxed condition with second end 84 in an abutting relationship with protrusion 74. As shown in FIGS. 10A and 10B, when the user pulls on the bottom rail (not shown), a clockwise rotation (as shown) of the axle 18 and the collar 76 occurs and causes the second end 84 of the spring 80 to disengage from protrusion 74. Spring 80 tightens on collar 76 such that rotation of the collar 76 is transmitted to reciprocator 78 via the contact between first end 82 of the spring 80 and reciprocator 78, which brings reciprocator 78 into abutment with protrusion 72. As the reciprocator 78 abuts against protrusion 72, the spring 80 relaxes again and the drive axle 18 may continue to rotate as the user further pulls on the bottom rail. Referring to FIGS. 11A and 11B, as the user releases the bottom rail at a desired height, spring 80 tightens on collar 76 and the drive axle 18, urged by the spring units 14 and 16 (FIG. 1), rotates reciprocator 78 in a counterclockwise direction until it reaches a locking position where protrusion 72 abuts against a stop 79 on the reciprocator 78. In this locking position, the spring 80 tightens to stop rotation of the drive axle 18 against the raising force exerted by spring units 14 and 16. Referring to FIGS. 12A and 12B, as the user pulls down slightly on the bottom rail, the spring 80 tightens and a resulting clockwise rotation of the drive axle 18 and collar 76 causes the reciprocator 78 to disengage from the locking position to a release position. When the user releases the bottom rail as shown in FIGS. 13A and 13B, the spring units 14 and 16 cause the drive axle 18 to rotate in a counterclockwise direction to bring second end 84 of the spring 80 into engagement with protrusion 74, and thereby loosening spring 80, which permits drive axle 18 to continue rotating and fully opening the window covering.

Figure 14:
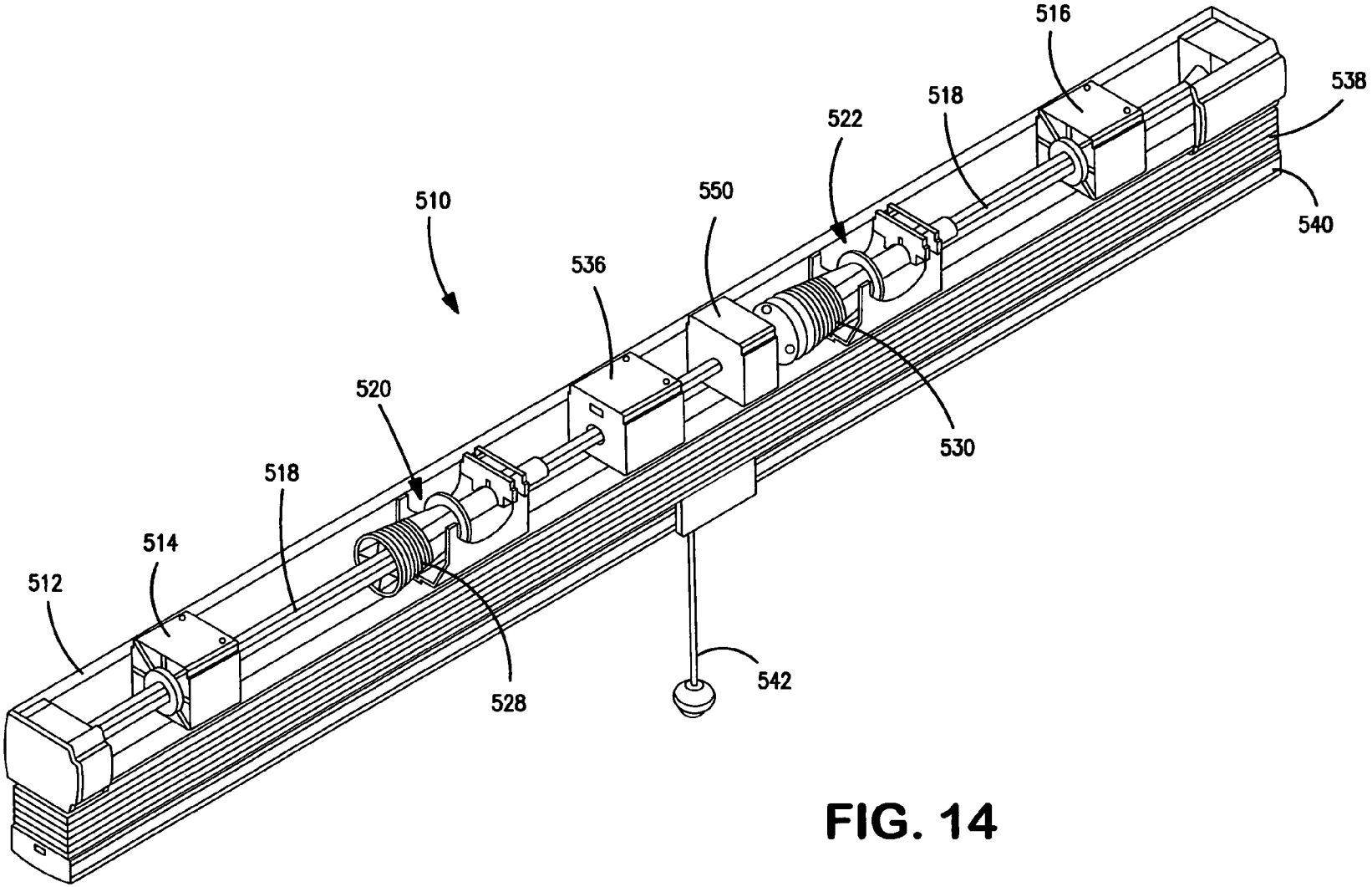
FIG. 14 is a perspective view of an alterative embodiment of a window covering according to the present invention with a deceleration member.

An alternative embodiment of the window covering according to the present invention is shown in FIG. 14. In most aspects, this embodiment is the same as the ones previously discussed. Window covering 510 includes a head rail 512 having a pair of spring units 514 and 516 mounted with a drive axle 518. Cord winding assemblies 520 and 522 are also provided. Raising cords 528 and 530 pass through shade element 538 and are connected with bottom rail 540. In addition, at least one deceleration member 550 is provided. Deceleration member 550 is engageable with one cord winding assembly 522 to slow down the rise of the bottom rail 540 as it approaches the head rail.

Figure 15A:
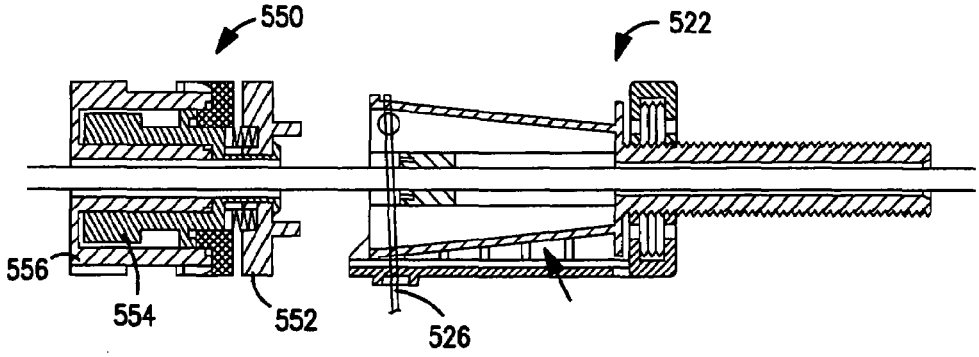
FIG. 15A is a side elevational cross section view of the deceleration member of FIG. 14 disengaged from one cord winding assembly.
Figure 15B:
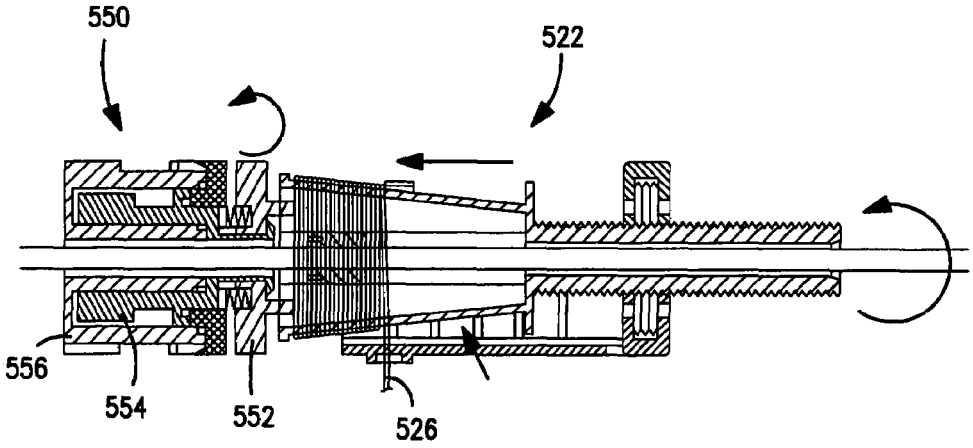
FIG. 15B is a side elevational cross section view of the deceleration member of FIG. 14 engaging one cord winding assembly.
Figure 15C:
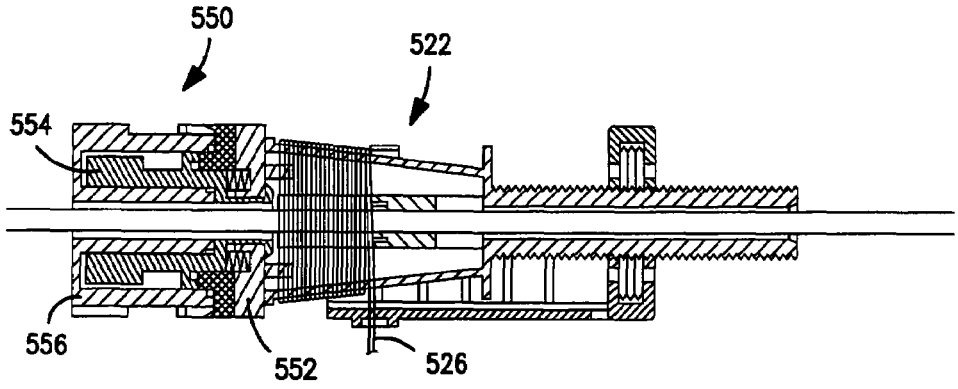
FIG. 15C is a side elevational cross section view of the deceleration member of FIG. 14 when the window covering is fully raised.

The preferred embodiment of the deceleration member 520 is shown in FIGS. 15A-15C. In the position of FIG. 15A, the cord winding assembly 522 is disengaged from the deceleration member 550. As the cord winding assembly 522 winds the cord 526, the cord winding assembly 522 also moves towards the deceleration member 550. As the cord winding assembly 522 engages with a plate 552 of the deceleration member 550 as shown in FIG. 15B, the rotation of the cord winding assembly 522 causes the plate 552 to rotate. The plate 552 is connected to an axle sleeve 554, which is in contact with a decelerating member, such as viscous oil liquid, contained inside a housing 556. The sleeve 554 is configured to achieve a resistant contact with the decelerating member to decelerate the rotation of the cord winding assembly. For example, protrusions or fins may be provided on the axle sleeve 554. The rate at which the bottom rail is raised by the spring units 514 and 516 is slowed as the bottom rail reaches the head rail so that the bottom rail more smoothly stops at a fully opened position.

The foregoing descriptions are to be taken as illustrative, but not limiting. Still other variants within the spirit and scope of the present invention will readily present themselves to those skilled in the art.

What is claimed is:

1. A control mechanism for a self-raising window covering, the window covering including a head rail, a suspended shade element, a bottom rail, and at least one raising cord operatively connected at a first end to the bottom rail, the control mechanism comprising:

a drive axle;

a drive unit operatively connected with the drive axle to apply a substantially constant rotational force on the drive axle;

at least one cord winding assembly mounted on the drive axle and including a winding portion having a first end with a first diameter and decreasing in diameter to a second end having a second diameter less than the first diameter, wherein the cord winding assembly is operable under the rotational force applied by the drive unit, to wind the raising cord for raising a suspended weight comprised of at least the bottom rail and a portion of the shade element that is stacked on the bottom rail, wherein the cord winding assembly includes a threaded tubular member that engages with one or more toothed rollers to cause an axial translation of the cord winding assembly along the drive axle as the cord winding assembly rotates; and a clutch member operatively connected with the drive axle, the clutch member being operable to lock the drive axle and block rotation of the drive axle against the rotational force applied by the drive unit, the clutch member further being operable to unlock the drive axle in response to a rotational force provided to the drive axle that is opposite to the rotational force of the drive unit.

2. The control mechanism of claim 1, wherein the drive unit comprises a constant force spring.

3. The control mechanism of claim 1, wherein the cord winding assembly is rotationally secured with the drive axle through a hub member adapted to engage the cord winding assembly and the drive axle.

4. The control mechanism of claim 3, wherein the hub member is in sliding engagement with the winding portion of the cord winding assembly.

5. The control mechanism of claim 1, wherein the clutch member comprises:

a reciprocator disposed coaxially relative to the drive axle and movable between a released position and a locked position; and a spring member connected to the reciprocator and operable to tighten and relax the hold of the reciprocator on the drive axle;

wherein the reciprocator is configured to cause the spring member to tighten on the drive axle in the locked position for blocking a rotation of the drive axle against the rotational force applied by the drive unit, and cause the spring member to relax the drive axle in the released position to permit a rotation of the drive axle under the rotational force applied by the drive unit.

6. The control mechanism of claim 5, wherein the clutch member further comprises an annular collar secured with the drive axle and having a peripheral surface around which the spring member is mounted.

7. The control mechanism of claim 1, further comprising a deceleration member engageable with the cord winding assembly to decelerate a rising movement of the bottom rail towards the head rail, the deceleration member providing a resistive force to the rotational force of the drive unit when the deceleration member is engaged with the cord winding assembly, and the rotational force of the drive unit is greater than the resistive force of the deceleration member.

8. A self-raising window covering, comprising:

a head rail defining an elongated channel;

a bottom member;

a shade element suspended between the head rail and the bottom member; and a control mechanism mounted within the channel of the head rail, the control mechanism including:

a drive axle operable to rotate under a substantially constant rotational force applied by a drive unit, wherein the operation of the drive axle is driven by the drive unit;

at least one cord winding assembly mounted on the drive axle and including a winding portion having a first end with a first diameter and decreasing in diameter to a second end with a second diameter less than the first diameter wherein the cord winding assembly further includes a threaded tubular member that engages with one or more toothed rollers to cause an axial translation of the cord winding assembly alone the drive axle as the cord winding assembly rotates;

at least one raising cord having a first end and a second end, the first end being secured towards the first end of the winding portion and the second end connected with the bottom member; and a clutch member operatively connected with the drive axle, the clutch member being operable to lock the drive axle and block rotation of the drive axle against the rotational force applied by the drive unit, the clutch member further being operable to unlock the drive axle in response to a rotational force provided to the drive axle that is opposite to the rotational force of the drive unit.

9. The window covering of claim 8, wherein the drive unit comprises a constant force spring.

10. The window covering of claim 8, wherein the cord winding assembly is mounted on the drive axle by a hub member.

11. The window covering of claim 10, wherein the hub member is in sliding engagement with the winding portion of the cord winding assembly.

12. The window covering of claim 8, wherein the clutch member comprises:

a reciprocator disposed coaxially relative to the drive axle and movable between a released position and a locked position; and a spring member connected to the reciprocator and operable to tighten and relax the hold of the reciprocator on the drive axle;

wherein the reciprocator is configured to cause the spring member to tighten on the drive axle in the locked position for blocking a rotation of the drive axle against the rotational force applied by the drive unit, and cause the spring member to relax the drive axle in the released position to permit a rotation of the drive axle under the rotational force applied by the drive unit.

13. The window covering of claim 12, wherein the clutch member further comprises an annular collar secured with the drive axle and having a peripheral surface around which the spring member is mounted.

14. The window covering of claim 8, wherein the control mechanism further comprises a deceleration member engageable with the cord winding assembly to decelerate a rising movement of the bottom member towards the head rail, the deceleration member providing a resistive force to the rotational force of the drive unit when the deceleration member is engaged with the cord winding assembly, and the rotational force of the drive unit is greater than the resistive force of the deceleration member.

15. The window covering of claim 8, wherein the shade element includes a collapsible cellular shade.

16. A self-raising window covering comprising:

a head rail;

a plurality of raising cords suspended from the head rail;

a bottom member suspended from the head rail by the raising cords;

a shade element suspended between the head rail and the bottom member;

a clutch member operatively connected with a drive axle, the clutch member being operable to lock the drive axle and block rotation of the drive axle against the rotational force applied by the drive unit, the clutch member further being operable to unlock the drive axle in response to a rotational force provided to the drive axle that is opposite to the rotational force of the drive unit;

the head rail further comprising a control mechanism, the control mechanism including a drive unit adapted to supply a substantially constant rotational force on the drive axle and a cord winding assembly co-axially mounted on the drive axle, the cord winding assembly configured to translate the rotational force of the drive unit to a linear raising force on the raising cords and wherein the cord winding assembly includes a threaded tubular member that engages with one or more toothed rollers to cause an axial translation of the cord winding assembly along the drive axle as the cord winding assembly rotates; and wherein the linear raising force supplied by the drive unit is sufficient to fully raise the bottom rail and shade element as the window covering is moved from a closed position to an open position.

17. The window covering of claim 16, wherein the cord winding assembly includes a winding drum having a tapered portion and a positioning member adapted to urge the cord winding assembly laterally along the drive axle when rotated.

18. The window covering of claim 16, wherein the cord winding assembly is rotationally secured with the drive axle by a hub member adapted to engage the cord winding assembly and the drive axle.

19. The window covering of claim 18, wherein the hub member is in sliding engagement with a tapered portion of the cord.

20. The window covering of claim 17, wherein the positioning member is a threaded tubular member.

21. The window covering of claim 16, wherein the drive unit comprises a constant force spring.

22. The window covering of claim 16, wherein the clutch member comprises a spring member adapted to releasably secure the position of the drive axle when in a tightened condition and to permit rotation of the drive axle when in a relaxed condition; the clutch member further including a reciprocator disposed annularly about the drive axle and adapted to selectively hold the spring member in the tightened and relaxed conditions.

23. The window covering of claim 22 further comprising an annular collar secured with the drive axle and connected with the spring member.

24. The window covering of claim 16, further comprising a deceleration member engageable and in a co-axial relation with the cord winding assembly, the deceleration member providing a resistive force to the rotational force of the drive unit when the deceleration member is engaged with the cord winding assembly, and the rotational force of the drive unit is greater than the resistive force of the deceleration member.

25. A self-raising window covering comprising:

a head rail;

a plurality of raising cords suspended from the head rail;

a bottom member suspended from the head rail by the raising cords;

a shade element suspended between the head rail and the bottom member;

a clutch member operatively connected with a drive axle, the clutch member being operable to lock the drive axle and block rotation of the drive axle against the rotational force applied by the drive unit, the clutch member further being operable to unlock the drive axle in response to a rotational force provided to the drive axle that is opposite to the rotational force of the drive unit;

the head rail further comprising a control mechanism, the control mechanism including a drive unit adapted to supply a substantially constant rotational force on the drive axle and a cord winding assembly co-axially mounted on the drive axle, the cord winding assembly configured to translate the rotational force of the drive unit to a linear raising force on the raising cords, the cord winding assembly further including a threaded tubular member that engages with one or more toothed rollers to cause an axial translation of the cord winding assembly along the drive axle as the cord winding assembly rotates, wherein the linear raising force supplied by the drive unit is sufficient to fully raise the bottom rail and shade element as the window covering is moved from a closed position to an open position; and a deceleration member engageable and in a co-axial relation with the cord winding assembly, the deceleration member providing a resistive force to the rotational force of the drive unit when the deceleration member is engaged with the cord winding assembly, and the rotational force of the drive unit greater than the resistive force of the deceleration member.

26. The window covering of claim 25, wherein the clutch member further includes a reciprocator disposed annularly about the drive axle and adapted to selectively hold the spring member in the tightened and relaxed conditions.

* * * * *